US012521598B2

(12) United States Patent
Mousel

(10) Patent No.: US 12,521,598 B2
(45) Date of Patent: Jan. 13, 2026

(54) BENCH PRESS EXERCISE SUPPORTING SYSTEM

(71) Applicant: John Arthur Mousel, Irvine, CA (US)

(72) Inventor: John Arthur Mousel, Irvine, CA (US)

( * ) Notice: Subject to any disclaimer, the term of this patent is extended or adjusted under 35 U.S.C. 154(b) by 106 days.

(21) Appl. No.: 18/650,192

(22) Filed: Apr. 30, 2024

(65) Prior Publication Data

US 2025/0332466 A1 Oct. 30, 2025

(51) Int. Cl.
*A63B 21/078* (2006.01)
*A63B 71/00* (2006.01)

(52) U.S. Cl.
CPC ..... *A63B 21/078* (2013.01); *A63B 71/0054* (2013.01); *A63B 2071/0063* (2013.01); *A63B 2225/093* (2013.01)

(58) Field of Classification Search
CPC ..... A63B 21/0078; A63B 21/0783; A63B 71/0054; A63B 2071/0063; A63B 2071/0072; A63B 2208/0252; A63B 2225/093
See application file for complete search history.

(56) References Cited

U.S. PATENT DOCUMENTS 5,306,220 A * 4/1994 Kearney ..... A63B 23/00 482/99
2018/0142832 A1* 5/2018 Inouye ..... F16M 13/022
2019/0275363 A1* 9/2019 Jones ..... A63B 21/06
2021/0170218 A1* 6/2021 Lewis-Dove ..... A63B 17/04
2023/0204154 A1* 6/2023 Inouye ..... F16M 13/022 248/221.11

FOREIGN PATENT DOCUMENTS

IT 201800003264 A1 * 9/2019 ..... A63B 23/1209

* cited by examiner

*Primary Examiner* — Gary D Urbiel Goldner
(74) *Attorney, Agent, or Firm* — Elizabeth Yang

(57) ABSTRACT

A bench press exercising user safety device comprises a pair of bench safe insert rods including a multitude of rod holes for detachable fastening to bench press machine uprights. Each bench safe insert rod is topped with a detachable foam cushion ball to provide impact protection and comfort. A pair of adjustable rods for customizable height extension is respectively attached to the bench press machine uprights, with horizontal rearward extenders respectively connected to top ends of the pair of adjustable rods. A pair of sightline bars is attached to a pair of vertical length extenders coupled to rear ends of the horizontal rearward extenders, respectively. Each sightline bar ends with a detachable sightline width plate for maintaining proper exercise posture and focus. A backside width adjuster and lock member adjusts a width between the pair of adjustable rods, and a vertically adjustable metal bump plate enables enhanced support and safety.

3 Claims, 4 Drawing Sheets

BENCH PRESS EXERCISE SUPPORTING SYSTEM

CROSS-REFERENCE TO RELATED APPLICATION

N/A

FIELD OF THE INVENTION

The present invention generally relates to the field of exercise equipment accessories. More specifically, the present invention relates to a novel bench press exercise supporting system that can be attached to a bench press equipment for providing support to an exercising user.

BACKGROUND OF THE INVENTION

Many people like performing compound exercises during workout for maximizing benefits. Bench press is a fundamental compound exercise focusing on chest and other parts of the body. Bench press is practiced by all weightlifters and exercising users. Conventionally, the bench press is performed with an exercising user lying supine on a flat bench, with feet placed on the floor. A barbell or a dumbbell is typically gripped with an overhand grip by the exercising user. When an exercising user lifts a heavy amount of weight or performs a lot of repetitions, then, muscular failure can occur. Accordingly, the barbell can fall onto the exercising user. Spotters may not always be available for providing support to the exercising user. People desire a safety accessory which can be used by existing bench press exercise equipment for providing safety to the lifter and preventing the barbell and weight from falling onto the lifter.

People also desire an exercise equipment accessory that can be used with all types of conventional bench press equipment and can be adjusted to meet requirements of different users.

SUMMARY OF THE INVENTION

This invention overcomes disadvantages of the prior art by providing a bench press exercising user safety device. The device is designed to be compatible with conventional bench press machines. The device includes a pair of bench safe insert rods, each rod includes a plurality of rod holes for detachable fastening to the front surfaces of the bench press machine uprights. Detachable foam cushion balls are disposed at the top ends of the bench safety insert rods. The cushion balls are designed to mitigate impact and enhance comfort for users, acting as a protective barrier against accidental contact with the metal rods during intense lifting sessions and accidental falling of the bench exercising rod.

In one embodiment of the present invention, the device includes a pair of adjustable rods, which are detachably attached to the bench press machine uprights. Each adjustable rod has a horizontal rearwardly extending bar at the top end thereof. The horizontal rearwardly extending bar is also attached to a length extender that vertically extends above the horizontal rearwardly extending bar thereby accommodating a wide range of exercises and user heights.

In another embodiment of the present invention, the device includes a sightline mechanism, which is fastened to the top end of the length extender. The mechanism includes a sightline width plate that is detachably fastened to the distal end of the sightline, serving as a visual aid for users to maintain proper alignment and focus during exercises.

In another aspect of the present invention, the device includes a backside width adjuster and lock member which is coupled to opposite thickness adjusting square members and offer further customization by allowing the width of the adjustable rods to be modified. The invention also includes a vertically adjustable metal bump plate, fastened to the bench safe insert rod and the adjustable rod, providing an extra layer of safety and support during use.

BRIEF DESCRIPTION OF THE DRAWINGS

The invention description below refers to the accompanying drawings, of which.

DETAILED DESCRIPTION OF THE PRESENT INVENTION

There are a great many possible implementations of the invention, too many to describe herein. Some possible implementations are described below. In the following description, for purposes of explanation, numerous specific details are set forth in order to provide a thorough understanding thereof. It should be clear, however, that the innovation can be practiced without various specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, any particular embodiment need not have all the aspects or advantages described herein. Thus, in various embodiments, any of the features described herein from different embodiments may be combined. It cannot be emphasized too strongly, however, that these are descriptions of implementations of the invention, and not descriptions of the invention, which is not limited to the detailed implementations described in this section but is described in broader terms in the claims.

The present disclosure outlines the design and features of a novel bench press equipment safety accessory device, as illustrated in various figures. The device is characterized by the ability to allow lifters to lift heavy weight without any additional assistance and requirement of a spotter.

Figure 1:
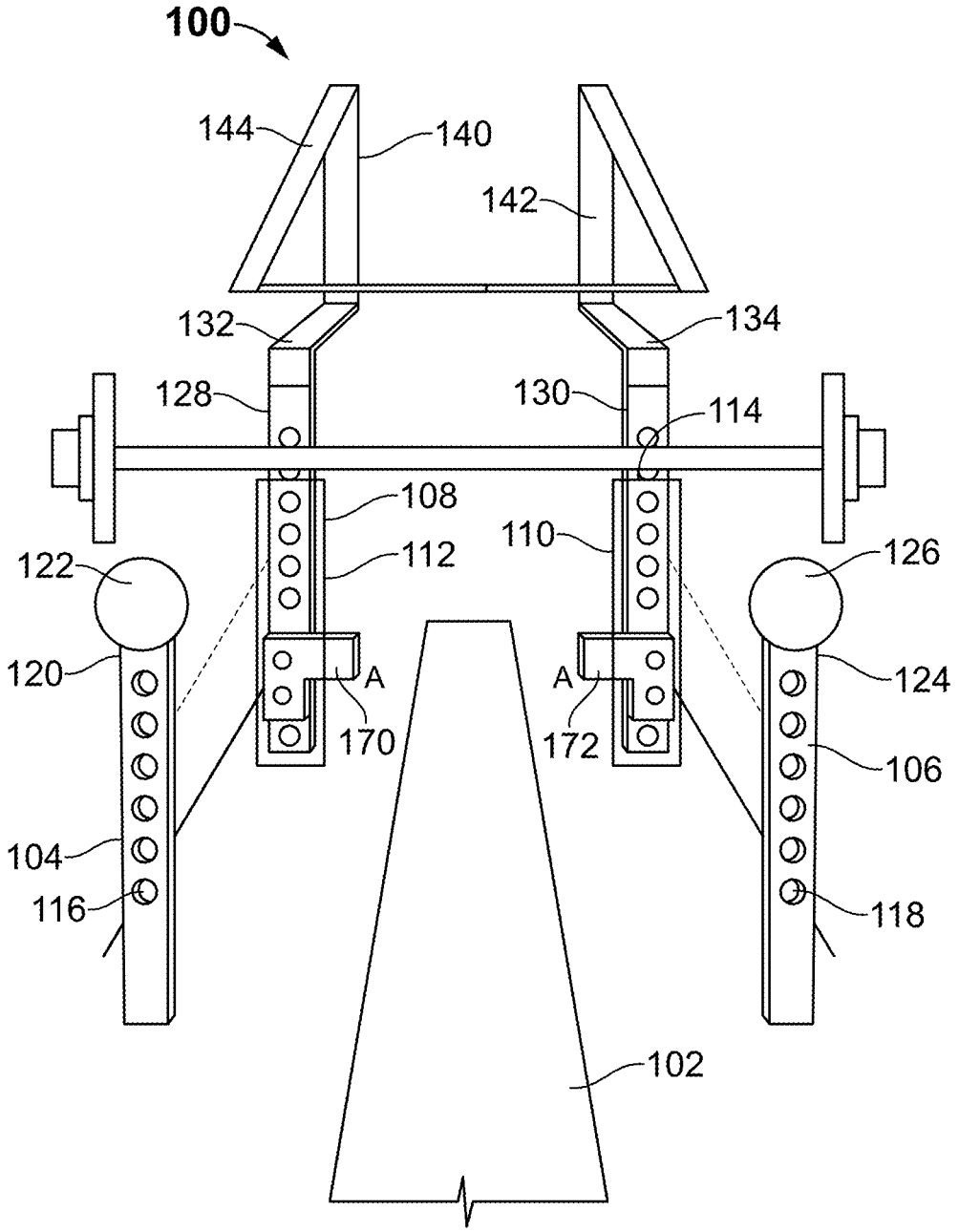
FIG. 1 illustrates a front perspective view of the bench press exercising user safety device 100 in accordance with one embodiment of the present invention.

FIG. 1 is a front perspective view of the bench press exercising user safety device of the present invention, according to an illustrative embodiment. Referring to FIGS. 1-4, the bench press exercising user safety device 100 is adapted to be used with a bench press exercising machine for providing support to an exercising user performing exercises on a bench press equipment 102. The device 100 includes a pair of bench safe insert rod 104,106 which are detachably fixed to the front surface 108,110 of the bench press machine uprights 112,114.

The first bench safe insert rod 104 has a plurality of rod holes 116 for detachably fastening to the first bench press machine upright 112. The second bench safe insert rod 106 has a plurality of rod holes 118 for detachably fastening to the second bench press machine upright 114.

The top end 120 of the first bench safe insert rod 104 has a detachable foam cushion ball 122 and the top end 124 of the second bench safe insert rod 106 has a detachable foam cushion ball 126.

Figure 2:
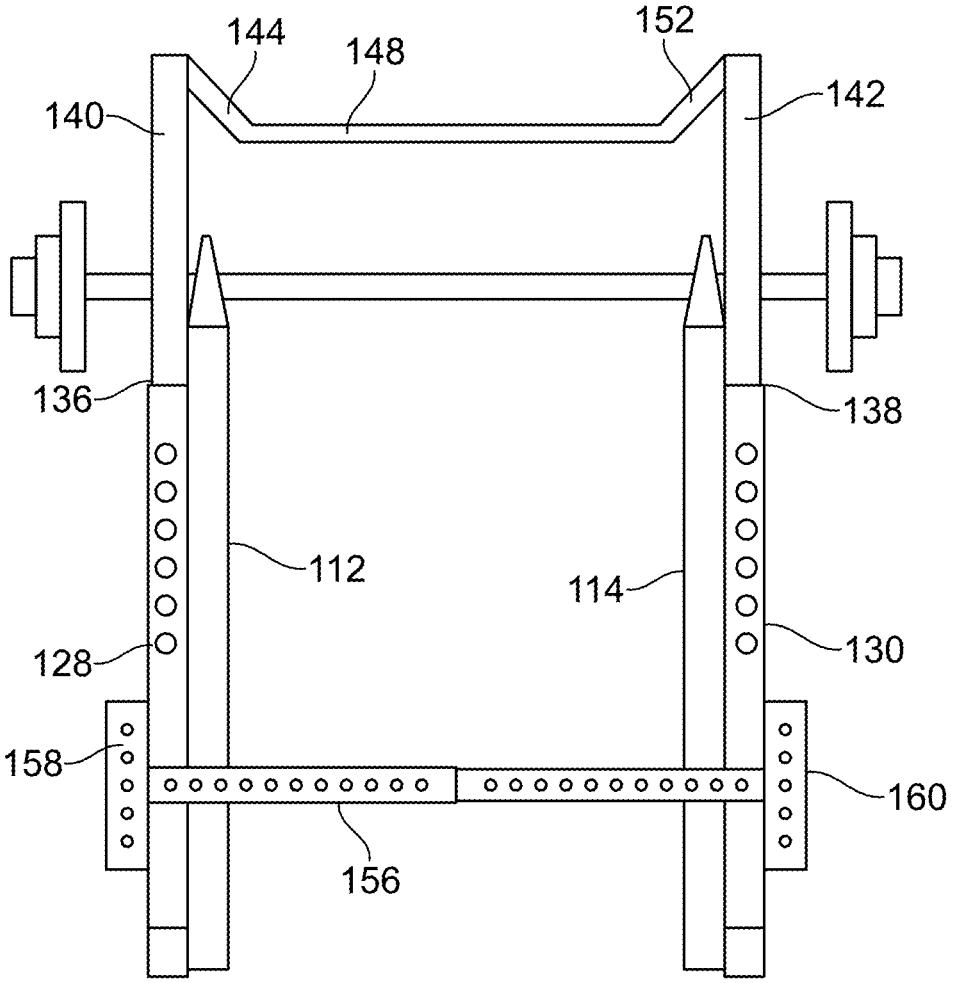
FIG. 2 illustrates a rear perspective view of the bench press exercising user safety device 100 in accordance with one embodiment of the present invention.
Figure 3:
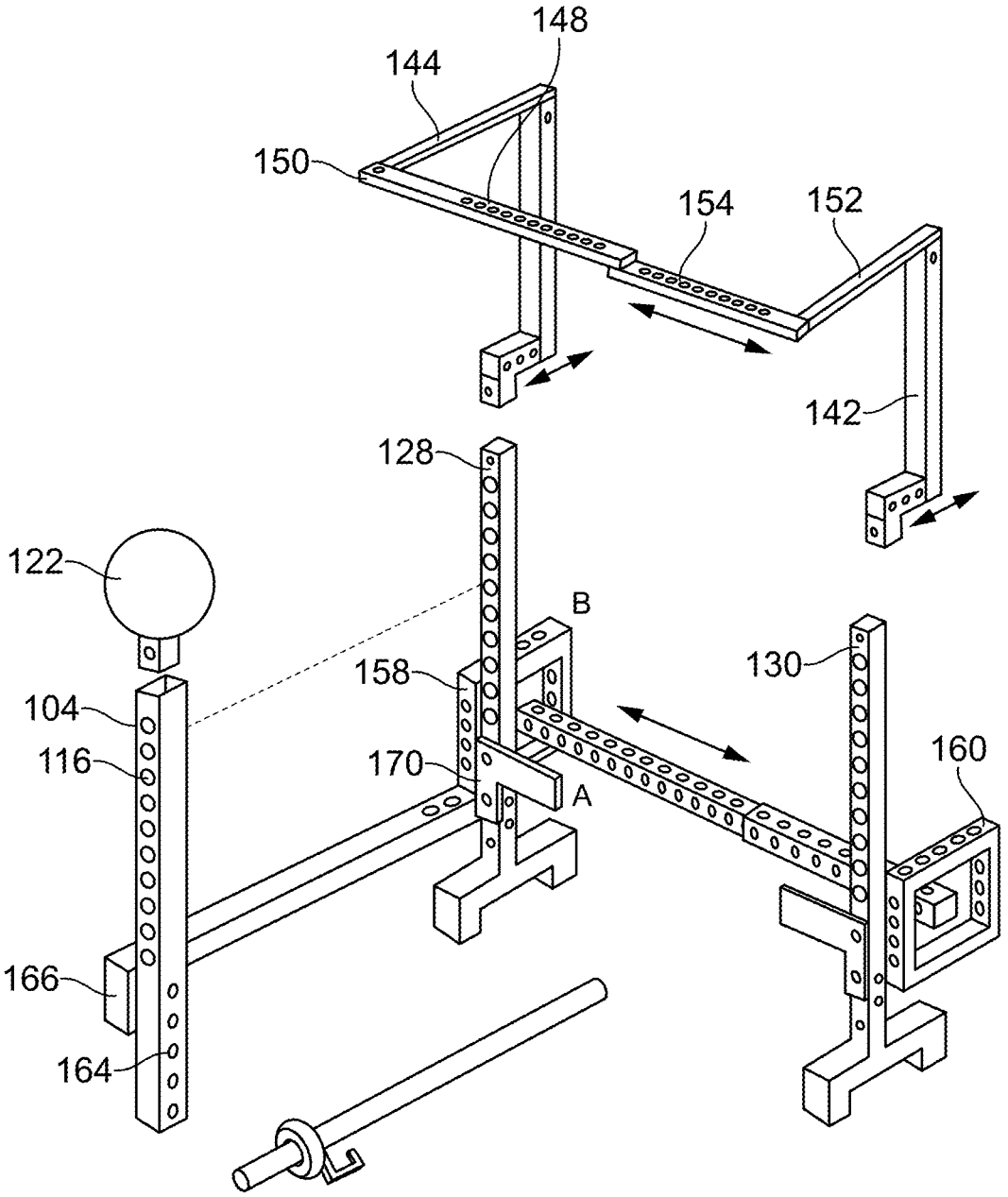
FIG. 3 illustrates an exploded view of the bench press exercising user safety device 100 in accordance with one embodiment of the present invention.

Referring now to FIGS. 1,2 and 3, a pair of adjustable rods 128,130 are detachably attached to the bench press machine uprights 112,114. A pair of horizontal rearwardly extending bars 132,134 are operatively connected on top ends 136, 138 of the rear adjustable rods 128,130. A length extender 140 is disposed on the horizontal rearwardly extending bar 132 and vertically extends above the horizontal rearwardly extending bar 132 and the corresponding length extender 142 is disposed on the horizontal rearwardly extending bar 134. A sightline 144 is plugged to the top end of the length extender 140 using a fastener 146 and a sightline width plate 148 is detachably fastened to the distal end 150 of the sightline 144. Similarly, a sightline 152 and a sightline width plate 154 is disposed on the corresponding length extender 142.

A backside width adjuster and lock member 156 is coupled to a pair of opposite thickness adjusting square members 158,160. The backside width adjuster and lock member 156 adjusts the width of the adjustable rods 128, 130.

Figure 4:
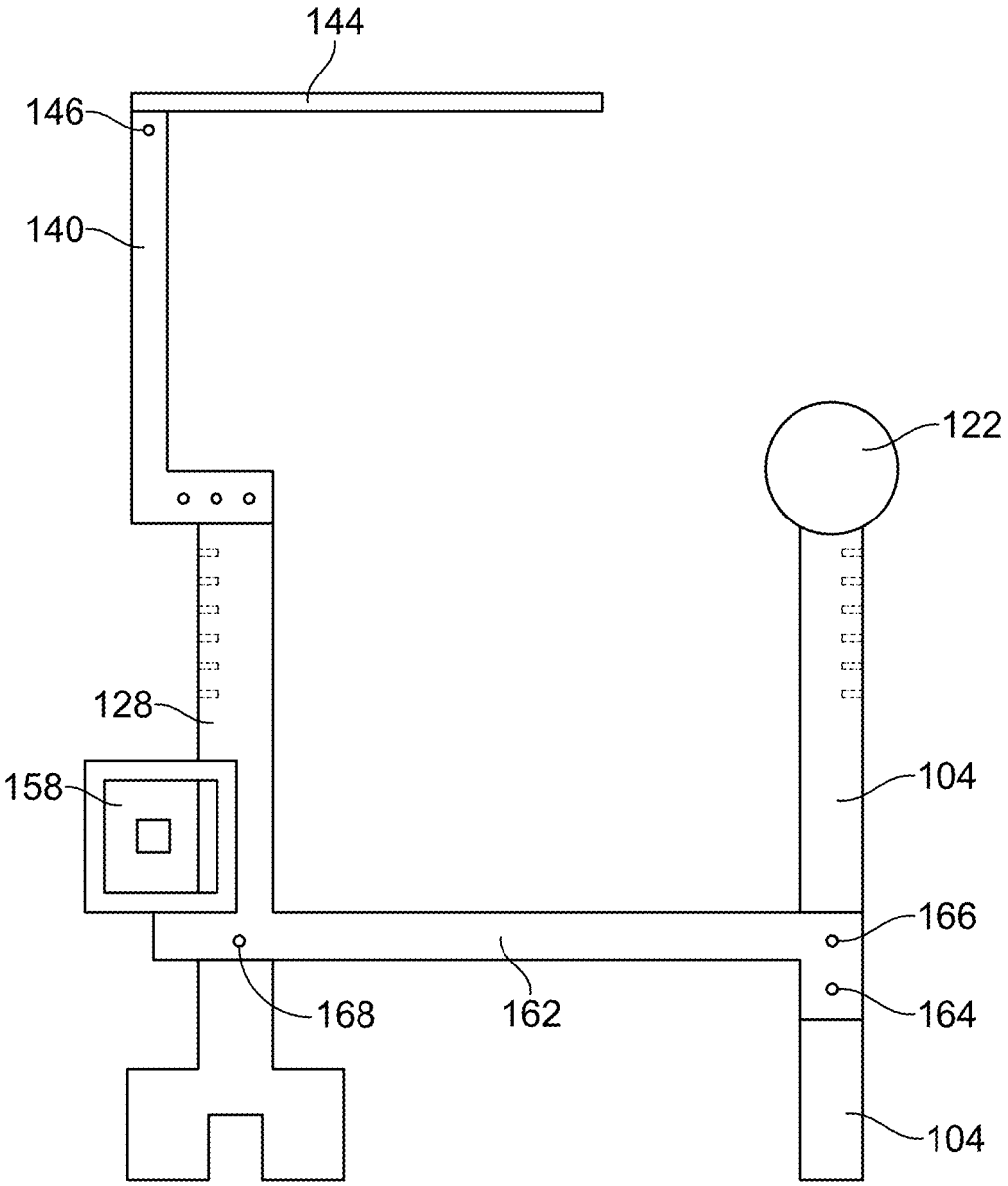
FIG. 4 illustrates a side perspective view of the bench press exercising user safety device 100 in accordance with one embodiment of the present invention.

Referring now to FIG. 4, a vertically adjustable metal bump plate 162 is fastened to the bench safe insert rod 104 and the adjustable rod 128. The metal bump plate 162 is L-shaped and is fastened to the bench safe insert rod 104 using mechanical fasteners passing through the apertures 164 at one end 166. The metal bump plate 162 is fastened to the adjustable rod 128 at the opposite end 168. It will be appreciated that the same metal bump plate is positioned between the other bench safe insert rod 106 and the adjustable rod 130.

A front side lock 170 is disposed on the adjustable rod 128 and an opposite side lock 172 is disposed on the other adjustable rod 130. The locks 170,172 are provided for additional security and support to the bench press exercising user safety device 100 of the present invention.

Furthermore, the described features, operations, or characteristics may be combined in any suitable manner in one or more embodiments. It will also be readily understood that the order of the steps or actions of the methods described in connection with the embodiments disclosed may be changed as would be apparent to those skilled in the art. Thus, any order in the drawings or Detailed Description is for illustrative purposes only and is not meant to imply a required order, unless specified to require an order.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A bench press exercising user safety device, comprising:

a pair of bench safe insert rods each having a plurality of rod holes, wherein the pair of bench safe insert rods are configured to be detachably fixed to a front surface of bench press machine uprights, respectively;

a detachable foam cushion ball located at a top end of each of the bench safe insert rods;

a pair of adjustable rods configured to be detachably attached to a rear surface of the bench press machine uprights;

a pair of horizontal rearwardly extending bars operatively connected to top ends of the pair of adjustable rods, respectively; and a pair of length extenders vertically extending from rear ends of the pair of horizontal rearwardly extending bars, respectively.

2. The bench press exercising user safety device of claim 1, further comprising a backside width adjuster coupled to a pair of opposite thickness adjusting square members, wherein the backside width adjuster is adapted to adjust a width between the pair of adjustable rods for accommodating various bench press machine sizes.

3. The bench press exercising user safety device of claim 1, further comprising a vertically adjustable metal bump plate fastened to a bench safe insert rod and the corresponding adjustable rod for providing additional support and safety during exercise.

* * * * *